United States Patent [19]

Mendenhall

[11] 4,309,113

[45] Jan. 5, 1982

[54] ASPHALTIC CONCRETE RECYCLE EXHAUST GAS TREATMENT APPARATUS AND METHOD

[76] Inventor: Robert L. Mendenhall, 1770 Industrial Rd., Las Vegas, Nev. 89102

[21] Appl. No.: 133,019

[22] Filed: Mar. 24, 1980

[51] Int. Cl.[3] ..... B28C 5/46

[52] U.S. Cl. ..... 366/4; 366/10; 366/25; 422/182; 432/72

[58] Field of Search ..... 366/2–5, 366/7, 10, 12, 25; 201/27; 202/263; 422/182, 183; 60/683; 110/211, 214; 126/343.5 A; 432/72; 34/32, 79

[56] References Cited

U.S. PATENT DOCUMENTS

| | | | |
|---|---|---|---|
| 2,879,862 | 3/1959 | Burden, Jr. | 422/182 X |
| 3,306,237 | 2/1967 | Ransom, Jr. | 432/72 X |
| 3,804,079 | 4/1974 | Schrader | 126/343.5 A |
| 3,840,215 | 10/1974 | McConnaughay | 366/25 |
| 3,940,253 | 2/1976 | Zetterstrom | 422/182 |
| 4,147,436 | 4/1979 | Garbelman et al. | 366/25 |

*Primary Examiner*—Philip R. Coe
*Attorney, Agent, or Firm*—Seiler & Quirk

[57] ABSTRACT

An improved process for cleaning asphaltic concrete recycle gases comprises introducing a flame into the exhaust gas stream at the opposite drum end that heating gases are introduced.

6 Claims, 3 Drawing Figures

ASPHALTIC CONCRETE RECYCLE EXHAUST GAS TREATMENT APPARATUS AND METHOD

BACKGROUND OF THE INVENTION

Recycling of asphaltic concrete has become increasingly important due to the steadily increasing costs of asphalt and aggregate which make up the composition. Methods and apparatus utilized in such a processing include those disclosed in my U.S. Pat. Nos. 3,849,040, 3,999,743, and patents to others such as 4,075,710, 4,147,436 and 4,165,184. Although the latter two patents speak generally of treating exhaust gases from the process in conventional dust filtration and collection apparatus prior to being vented to atmosphere, none of the methods disclosed adequately treat such exhaust gases to meet strict environmental pollution standards.

Where asphaltic concrete is recycled according to presently preferred technology, it is taken up from the road or highway surface and crushed into a variety of particle sizes, such as disclosed in my aforesaid U.S. Pat. No. 3,999,743. It is then introduced into an elongated drum into which flame and hot gases of combustion are directed, thereby exposing the asphalt containing particles to the hot gases, in order to heat the composition and make it more plastic. Make-up asphalt and/or softening agents as disclosed in my U.S. Pat. No. 4,000,000 are also usually mixed with the molten material during processing. Normally, the asphaltic concrete recycle processes result in composition recovered having temperatures of above 200° F., and usually above 225° F., and product temperatures of 240° F. or more are not uncommon. When the recycle product mixture is heated to such temperatures, substantial amounts of volatile and combustible hydrocarbon gases are given off by the hot asphalt. Such hydrocarbon volatiles mixed with the hot exhaust gases and at temperatures equal to or greater than the product temperatures, are of sub-micron size, and are simply not removed by conventional dust collectors, or even scrubbers, prior to being vented to atmosphere. Moreover, these volatile asphalt hydrocarbons are quite visible, as well as being generally undesirable as atmospheric pollutant materials.

In my prior U.S. Pat. Nos. 4,104,736 and 4,153,471, there are disclosed processes and apparatus for treating exhaust gaseous mixtures from such recycle operations as described hereinabove. Although these processes for treating the exhaust gases are useful, their apparatus features do not lend themselves for being easily adopted for use with conventional dust collecting and/or scrubbing equipment associated with the drum heating and mixing apparatus. It is to the improvement of known asphaltic concrete recycling appratus, particularly to modification of the apparatus for handling and treating exhaust gases containing combustible asphalt hydrocarbon volatile gases, that the present invention is directed.

SUMMARY OF THE INVENTION

The present invention is directed to improvement in handling exhaust gases from processing asphalt-aggregate compositions in which the asphalt containing material is directly exposed to hot gases of combustion, and which exhaust gases contain volatile asphalt hydrocarbon materials. In the process, prior to treatment of the exhaust gases in a dust collector, scrubber, and/or other conventional gas treatment to reduce atmospheric pollutants, the exhaust gaseous stream in the drum is directed through an opening at the output drum end, and flame is introduced into the exhaust gas stream at or through the opening to ignite the volatile hydrocarbon material therein. The advantages of the invention as well as further description of the process and apparatus will be evident from the following detailed description.

DETAILED DESCRIPTION OF THE INVENTION

Figure 1:
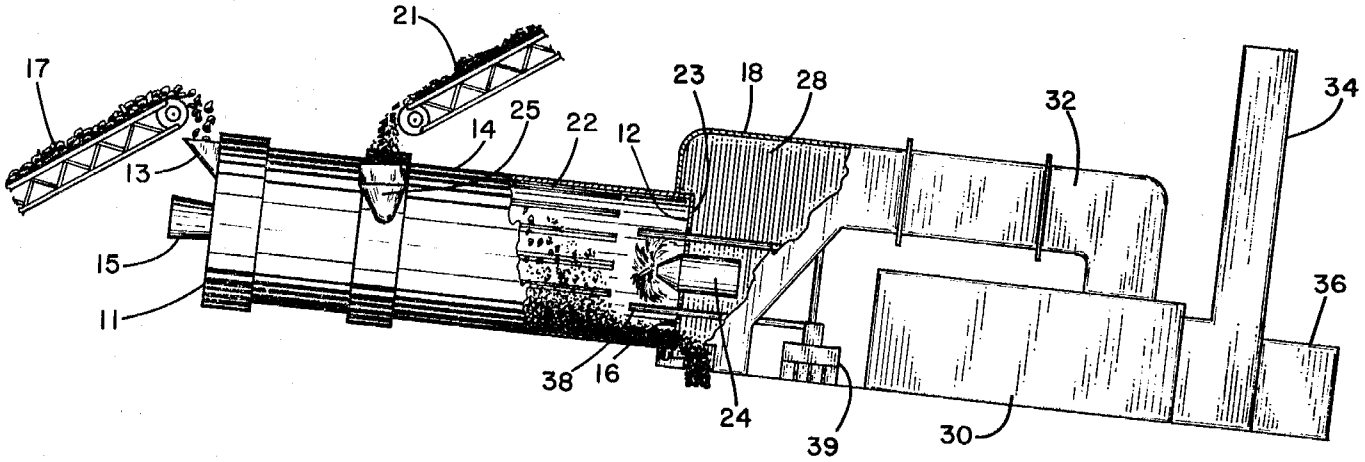
FIG. 1 is a view, partially in section, illustrating apparatus of the invention.

In FIG. 1 there is shown a drum 14 having a burner 15 at an input drum end 11, in which drum asphalt-aggregate composition is treated. The drum is rotatable, and includes multiple ports for introducing composition, including hoppers 13 and 25, into which composition is directed, and which hoppers cooperate with ports for introducing composition into the interior of the drum 14. The apparatus and process of the invention is specially suitable for recycling asphaltic concrete according to methods disclosed in my U.S. Pat. Nos. 3,999,743, and 4,177,080. In the former Patent, the material introduced into the apparatus is all crushed asphaltic concrete, coarse composition being introduced at the input drum end at a chute corresponding to chute 13, and smaller particles being introduced into the drum in a cooler zone, via a hopper corresponding to hopper 25. In the process described in the later patent, virgin aggregate is introduced into the hot drum zone, and the recycled asphaltic concrete introduced into the cooler drum zone. Either of these processes and drum apparatus may be used according to the present invention, the description thereof being incorporated herein by reference. Moreover, other processes and apparatus including those described in the previously disclosed patents may be used in treating the asphalt-aggregate compositions according to the invention. It is the treatment of the exhaust gases from any such processes of directly exposing asphaltic concrete compositions to hot gases of combustion that the present invention is directed.

In the apparatus shown, the product is recovered from drum 14 at or adjacent output drum end 23. The product recovered normally has a temperature of at least about 200° F., and usually preferably above about 225° F. The exhaust gases are also directed from output drum end 23 into exhaust gas shroud 18. The gas exhaust treatment apparatus, except that incorporating the present invention, may be of conventional design, as previously noted, such as disclosed in U.S. Pat. No. 4,147,436. The exhaust gas may be pulled from the output drum end 25 by exhaust fan 36, successively through passageway 28, along the exhaust duct 32, and into the dust filtration and collection apparatus 30, which may include a scrubber, or the like. The gas is then vented to atmosphere via stack 34.

The specific improved feature of the apparatus of the invention for treating the volatile asphalt hydrocarbon containing exhaust gas, is in providing one or more burners at the drum output end which direct flame into or through the opening, port or ports, through which the exhaust gas passes. Specifically, observing FIG. 1, at the output drum end 23, there is a plate 12 having an opening or port 16 therein through which the exhaust gas from the drum is pulled into the exhaust gas shroud 18 as previously explained. With the exhaust gas being directed substantially through port 16, according to the present invention, it is beneficial to direct a flame into the exhaust gas stream at or through port 16. For this purpose, burner 24 is installed, and preferably directs a flame into drum 14 toward the input drum end 11.

Because the diameter of port 16 is somewhat restricted in comparison to the drum interior diameter and the size of the passageway 28 in exhaust gas shroud 18 on the other side of plate 12, as the exhaust gas is pulled from the drum, through port 16, and into the exhaust gas shroud and assembly, there will be a slightly or somewhat lower pressure on the exhaust gas shroud side of plate 12 as compared to the gas pressure on the drum side of the plate. This will also cause the exhaust gas velocity to be increased somewhat at the port, and, combined with the flow of exhaust gas, will assist in preventing the flame being directed toward input drum end 11 by burner 24, from extending at any great or substantial distance within the drum interior. Again, because of the relatively lower gas pressure on the gas exhaust shroud side of plate 12, this will cause the flame to be pulled in the direction of the gas exhaust stream, through port 16. Thus, the flame will fan or "bloom" in a manner as illustrated in the drawings rather than being projected in a normal manner toward the input drum end, as would otherwise occur.

Figure 3:
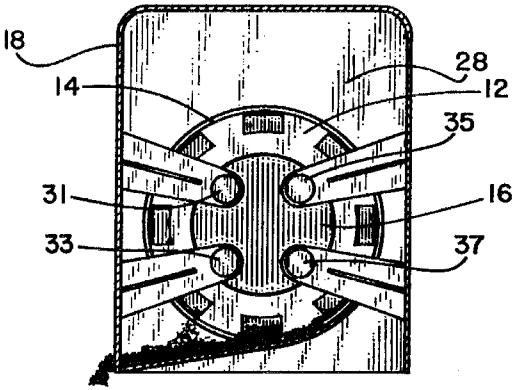
FIG. 3 is a view taken along 3—3 of FIG. 2.
Figure 2:
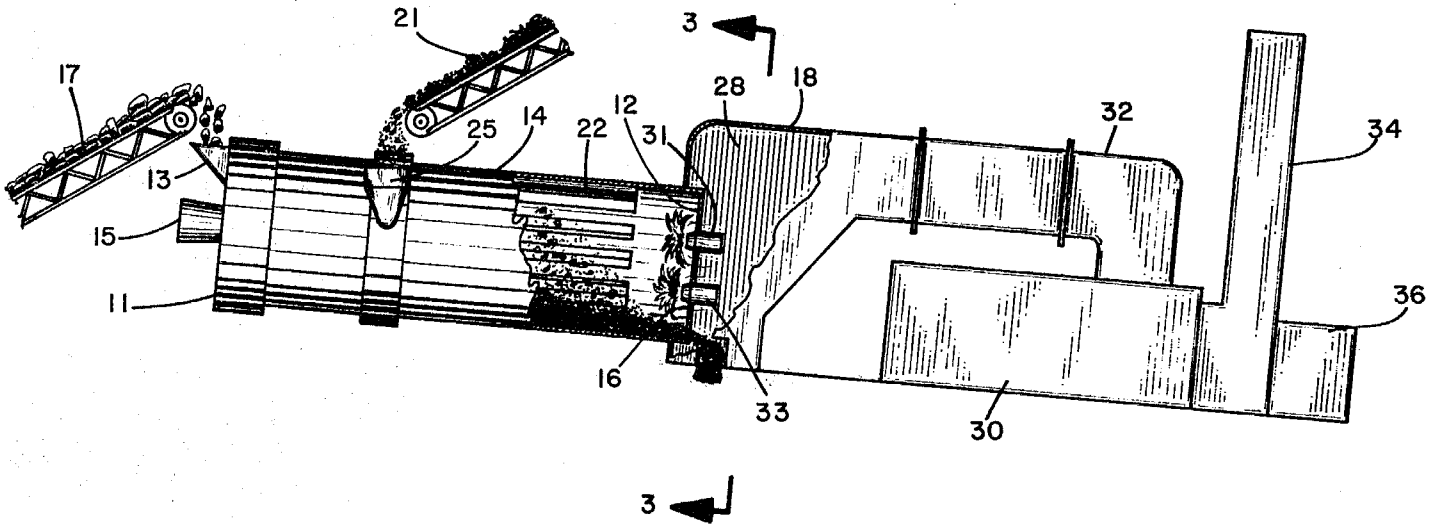
FIG. 2 is a partial sectional view showing another embodiment of the apparatus.

Although the apparatus may incorporate a single burner as illustrated in FIG. 1, a plurality of such burners may be used instead, the advantage being a broader area of flame dispersed into the passing exhaust gas stream, with resulting improved or increased efficiency for burning of the unburned hydrocarbons. As shown in FIGS. 2 and 3, the four burners, 31, 32, 35 and 37 are spaced around port 16 through which most of the exhaust gas from the drum must pass. It will be appreciated that any number of burners may be used and positioned for directing the flame advantageously into or through the opening or openings through which the exhaust gas passes. Again, because of the difference in the gas pressure on the upstream and downstream side of a plate 12 as shown, it is preferable that the burner be positioned so that the burner nozzle extends into the drum interior so that the flame itself will also be directed into the drum interior. Thus, most of the heat from the flame as well as the combustion of the combustible hydrocarbons in the exhaust stream will take place within the drum, rather than heating the shroud and exhaust gas conduit exteriorally of the drum.

Because the exhaust gas stream at the output drum end is usually lacking in oxygen, it is preferred to vent additional oxygen containing gas into the exhaust gas stream, at, or prior to burning the combustible hydrocarbons. For this purpose, the gas can be injected into the burner, or a blower 39 may be incorporated for forcing oxygen containing gas through pipes 38 into the drum upstream from or near the area of the flame. The exhaust gas port 16 in plate 12 may be any suitable size, with smaller openings resulting in the gas pressure differential discussed above. Such a plate will also require product recovery ports spaced around its perimeter as shown in FIG. 3, and through which some exhaust gas may be forced. However, where sufficient burners are used to give extensive flame exposure at the output drum end, a plate may not be required. Alternatively, a small plate over which the product may flow, may also be used. However, other suitable means may also be used to achieve the same purpose. These as well as other advantages and modifications of the apparatus and method disclosed within the purview of the invention will be evident to those skilled in the art.

I claim:

1. In a process for heating and mixing asphaltic concrete in an elongated rotatable drum having an input end and an opposite output end, supplying hot gases of combustion at said input end and directing said hot gases substantially along the length of said drum from said input end to said output end, wherein said composition is directed along said drum toward said output end while being exposed directly to said hot gases, and resulting in a stream of exhaust gases flowing out of said output end containing combustible hydrocarbon gases from the heated asphalt, the improvement comprising:

burning said combustible hydrocarbon gases by directing flame into said drum adjacent said output end and into said stream of exhaust gases and toward said drum input end.

2. The process of claim 1 including directing oxygen containing gas into said exhaust gases.

3. The process of claim 2 wherein said oxygen containing gas is directed into said exhaust gases before the combustible hydrocarbon gases are burned.

4. In an apparatus for heating and mixing asphaltic concrete composition comprising an elongated rotatable drum having an input end and an opposite output end, means for supplying hot gases of combustion at said input end toward said output end, means for recovering heated composition at said output end, and a port at said output end for venting exhaust gases therefrom, the improvement comprising:

burner means adjacent said port for directing flame into said drum toward said input end.

5. The apparatus of claim 4 wherein said burner means comprises at least one burner having a nozzle extending through said port.

6. The apparatus of claim 4 including means for introducing oxygen containing gas into said drum upstream from said port.

* * * * *